United States Patent [19]

Mitchell et al.

[11] Patent Number: 4,757,657

[45] Date of Patent: Jul. 19, 1988

[54] FLOOR-TO-CEILING WALL SYSTEM

[75] Inventors: Terry L. Mitchell, Jenison; Glenn D. Steil, Grand Rapids; Lawrence J. Spoolstra, Byron Center, all of Mich.

[73] Assignee: Architectural Wall Systems, Inc., Grand Rapids, Mich.

[21] Appl. No.: 914,134

[22] Filed: Oct. 1, 1986

Related U.S. Application Data

[63] Continuation-in-part of Ser. No. 869,439, Jun. 2, 1986, Pat. No. 4,709,517.

[51] Int. Cl.[4] ..... E04H 1/00

[52] U.S. Cl. ..... 52/241; 52/243; 52/243.1; 52/632; 403/12; 403/377

[58] Field of Search ..... 52/241, 242, 243, 243.1, 52/632; 403/377, 378, 379, 362, 12

[56] References Cited

U.S. PATENT DOCUMENTS

| | | | |
|---|---|---|---|
| 1,193,575 | 8/1916 | McFarland . | |
| 1,694,690 | 12/1928 | Reinhold . | |
| 2,055,442 | 9/1936 | Jones . | |
| 2,325,766 | 8/1943 | Gisondi . | |
| 2,766,855 | 10/1956 | Johnson . | |
| 2,768,410 | 10/1956 | Woodard | 52/217 |
| 2,796,158 | 6/1957 | Miles . | |
| 2,936,049 | 5/1960 | Horind | 52/241 |
| 2,968,374 | 1/1961 | Bohnsack . | |
| 3,001,615 | 9/1961 | Ries | 52/241 |
| 3,093,218 | 6/1963 | Peterson . | |
| 3,180,457 | 4/1965 | Bohnsack . | |
| 3,191,727 | 6/1965 | Schmeltz . | |
| 3,205,630 | 9/1965 | Felix . | |
| 3,339,954 | 9/1967 | Alvden | 52/127.7 |
| 3,358,411 | 12/1967 | Birum . | |
| 3,395,504 | 8/1968 | Zwickert . | |
| 3,451,183 | 6/1969 | Lespagnol | 52/656 |
| 3,482,706 | 12/1969 | Stewart . | |
| 3,508,364 | 4/1970 | Thompson | 52/126.4 |
| 3,619,960 | 11/1971 | Thompson | 52/241 |
| 3,621,635 | 11/1971 | De Lange . | |
| 3,631,647 | 1/1972 | Merkin . | |
| 3,638,387 | 2/1972 | Lickliter | 52/741 |
| 3,680,271 | 8/1972 | Satchell . | |
| 3,724,150 | 4/1973 | Hudnall . | |
| 3,733,756 | 5/1973 | Butler . | |
| 3,745,708 | 7/1973 | Gulistan . | |
| 3,755,979 | 9/1973 | Pantazi . | |
| 3,830,027 | 8/1974 | Paisley . | |
| 3,831,333 | 8/1974 | Nelsson | 52/241 |
| 3,837,128 | 9/1974 | O'Brien | 52/241 |
| 3,845,601 | 11/1974 | Kostecky | 52/290 |
| 3,897,668 | 8/1975 | McDonnell | 52/241 |
| 3,948,011 | 4/1976 | Price | 52/241 |
| 3,952,462 | 4/1976 | Heise | 52/62 |
| 3,983,670 | 10/1976 | Lightfoot . | |
| 3,990,205 | 11/1976 | Davis . | |
| 4,034,535 | 7/1977 | Dustmann . | |
| 4,037,380 | 7/1977 | Pollock . | |
| 4,041,667 | 8/1977 | Lindner . | |
| 4,103,463 | 8/1978 | Dixon . | |
| 4,120,124 | 10/1978 | Temple . | |
| 4,245,442 | 1/1981 | Durham . | |
| 4,287,698 | 9/1981 | Baus | 52/741 |
| 4,356,672 | 11/1982 | Beckman . | |
| 4,397,127 | 4/1983 | Mieyal | 52/241 |
| 4,458,462 | 7/1984 | Schold . | |

FOREIGN PATENT DOCUMENTS

| | | | |
|---|---|---|---|
| 54872 | 4/1976 | Australia . | |
| 226926 | 4/1963 | Austria | 52/241 |
| 253177 | 6/1969 | Austria . | |
| 2036962 | 11/1971 | Fed. Rep. of Germany . | |
| 2510949 | 9/1981 | Fed. Rep. of Germany . | |
| 2238020 | 7/1977 | France . | |
| 7900373 | 4/1976 | Netherlands . | |
| 580623 | 11/1971 | United Kingdom . | |
| 2070100 | 9/1973 | United Kingdom . | |

*Primary Examiner*—Henry E. Raduazo

*Attorney, Agent, or Firm*—Price, Heneveld, Cooper, DeWitt & Litton

[57] ABSTRACT

The specification discloses a floor-to-ceiling partition system including telescoping studs wherein resiliently compressible friction members are positioned on each side of the upper portion of said studs near the upper ends thereof for frictional engagement with the inner surfaces of the sidewalls of a ceiling channel mounted on a ceiling.

19 Claims, 4 Drawing Sheets

FLOOR-TO-CEILING WALL SYSTEM

CROSS REFERENCE TO RELATED APPLICATION

The present patent application is a continuation-in-part of U.S. patent application Ser. No. 06/869,439 filed June 2, 1986 and now U.S. Pat. No. 4,709,517 and entitled FLOOR TO CEILING WALL SYSTEM.

BACKGROUND OF THE INVENTION

The present invention relates to floor-to-ceiling room partition systems. At least one such system, disclosed in U.S. Pat. No. 2,796,158 to Miles et al. and entitled WALL ASSEMBLY, discloses the use of telescoping vertical studs. Such studs include a lower member and an upper telescoping member which makes it possible to adjust the height of the stud to accommodate different floor-to-ceiling distances.

While such an approach seemed desirable, one problem encountered when adapting the telescoping stud system to a slotted stud is that the upper telescoping portion, if it is long enough to give substantial variability in height, may interfere with the hanger bracket receiving slots in the lower stud member. Finding a suitable means for securing the upper telescoping member to the ceiling and for securing it against further movement with respect to the lower member is also a problem. Systems tend to be either too complex, too permanent or too unreliable. This could result in the upper portion of the telescoping stud dropping into the lower portion, weakening an entire partition section.

These drawbacks have hindered the use of telescoping studs in floor-to-ceiling wall partition systems.

SUMMARY OF THE INVENTION

In the floor-to-ceiling partition system of the present invention, a telescoping stud is employed in which the upper member includes means for receiving at least one resiliently compressible friction member. The system also includes ceiling channels into which the upper telescoping stud member is fitted, with the resiliently compressible member in force fitting engagement with at least one wall of the ceiling channel.

These and other objects, advantages and features of the present invention will be more fully understood and appreciated by reference to the written specification and appended drawings.

DETAILED DESCRIPTION OF THE PREFERRED EMBODIMENT

Figure 5:
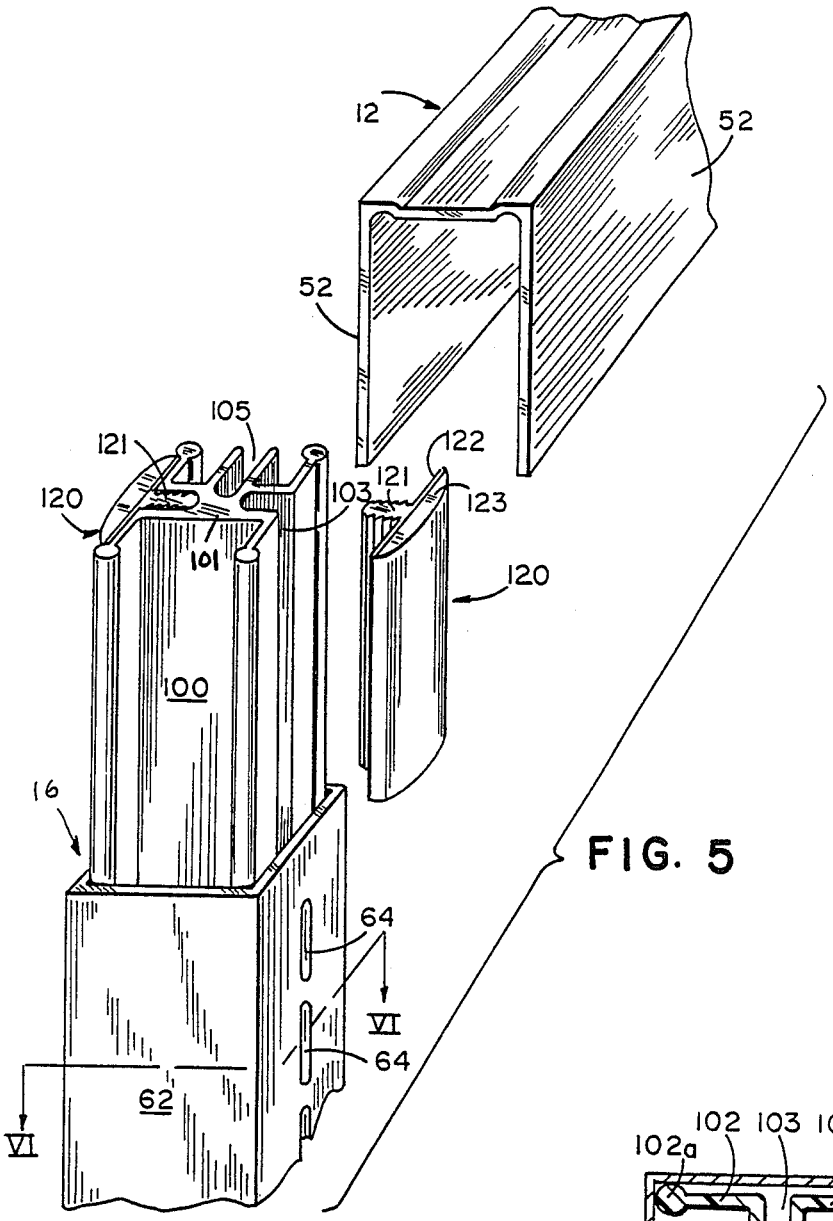
FIG. 5 is a fragmentary, perspective view of the upper end of one of the vertical studs being assembled onto the ceiling channel, taken in the region of arrow V in FIG. 4.
Figure 6:
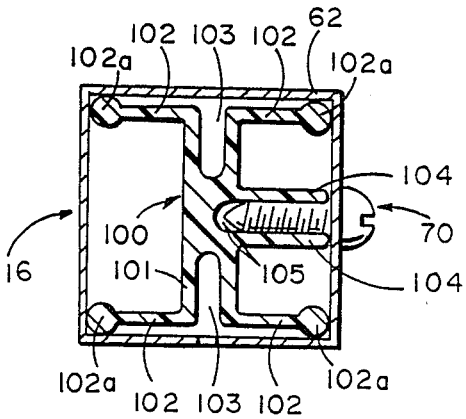
FIG. 6 is a cross-sectional view taken along plane VI—VI of FIG. 5.

In the preferred embodiment, the wall system 10 of the present invention includes a ceiling channel 12 and a floor leveler channel or assembly 14. A series of telescoping vertical studs 16 extend between ceiling bracket 12 and floor leveler assembly 14. A set of generally horizontal stringers 18 span between adjacent vertical studs 16, while wall panels 20 are hung from stringers 18. Each telescoping stud 16 includes a lower tubular member 62 and an upper telescoping member 100 which is adapted to receive resiliently compressible members 120 (FIG. 5). Resiliently compressible members 120 are located towards the top of upper telescoping member 100 and are frictionally fit into the space between sidewalls 52 of ceiling channel 12. The upper portion of telescoping stud 16 can then be slid within channel 12 until it is properly vertically aligned, and then upper member 100 can be secured against telescoping movement with respect to lower member 62 by means of screw 70 as illustrated in FIG. 6.

During assembly of wall system 10, one entire wall is levelled simultaneously by the adjustment of floor leveler assembly 14. A first vertical stud 16 is supported between the ceiling channel and the floor leveler assembly, and this first stud 16 is vertically aligned and secured in place. Thereafter the next adjacent stud 16 is positioned between ceiling channel 12 and floor leveler assembly 14, and a set of stringers 18 are secured between the first vertical stud 16 and the next successive stud 16. The securing of stringers 18 aligns the adjacent studs 16, and the remaining successive vertical studs 16 are aligned by the sequential placement of stringers 18 between successive vertical studs 16.

Figure 2:
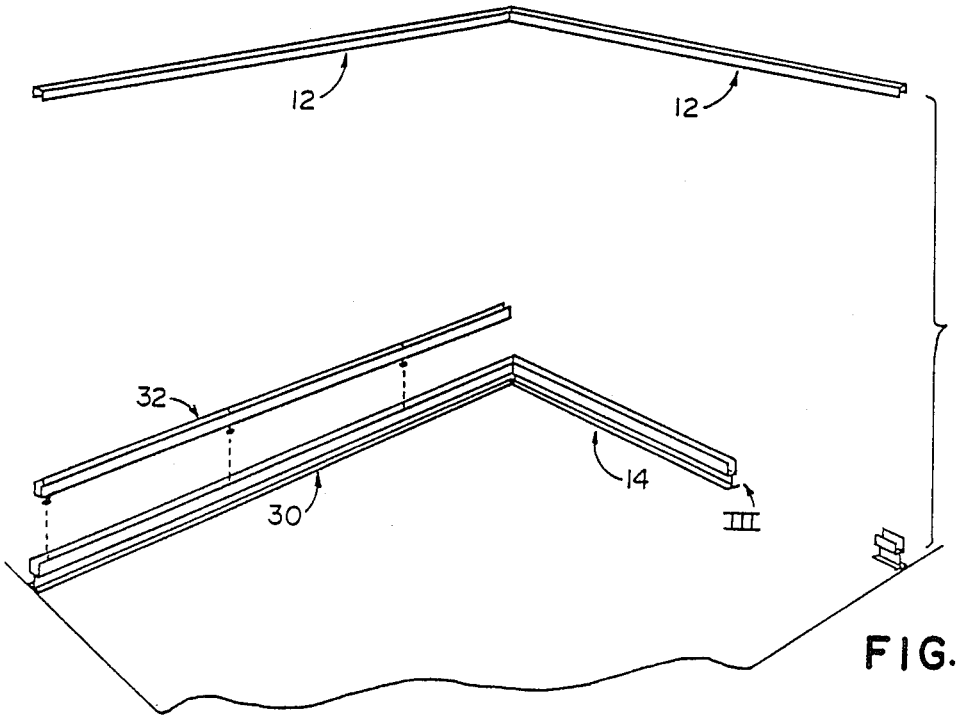
FIG. 2 is a perspective, exploded view of the ceiling channel and floor leveler assembly used in the system shown in FIG. 1.

Initially, as shown in FIG. 2 ceiling channel 12 is secured along the structural ceiling and floor leveler assembly 14 is positioned on the floor surface generally aligned beneath ceiling channel 12. As shown in FIG. 2, ceiling channel 12 and floor leveler assembly 14 are positioned to partition off a corner area of a work space and therefore two sets of ceiling channels 12 and floor leveler assemblies 14 extend at right angles between two corner structural walls. Although a single set of elements for wall system 10 are described, wall system 10 may be used to provide a single wall, a four walled enclosure or any other combination required for a given work environment.

Floor leveler assembly 14 includes a floor track or runner 30 (FIG. 3) and a leveler channel 32. The base of floor runner 30 has a generally "I" beam construction that spaces a raised upper channel 34 above the floor surface. Upper channel 34 is a generally rectangular, upwardly opening "U" shaped channel in which leveler channel 32 is received. Floor runner 30, including its base portion and upper channel 34, is extruded as a single piece. Leveler channel 32 is an elongated, upwardly opening "U" shaped bracket that closely nests in upper channel 34. A series of adjustment bolts 36 are spaced along leveler channel 32 and extend between leveler channel 32 and upper channel 34. Each adjustment bolt 36 has a slotted upper end 38 that permits a screwdriver to be inserted for the adjustment of bolt 36. Adjustment bolts 36 are threaded through a Tinnerman TM nut 39 and the undersurface of leveler bracket 32, and the heads 40 of bolts 36 rotatably abut upper channel 34 so that the adjustment of bolts 36 raises or lowers leveler channel 32 relative to floor runner 30.

Figure 3:
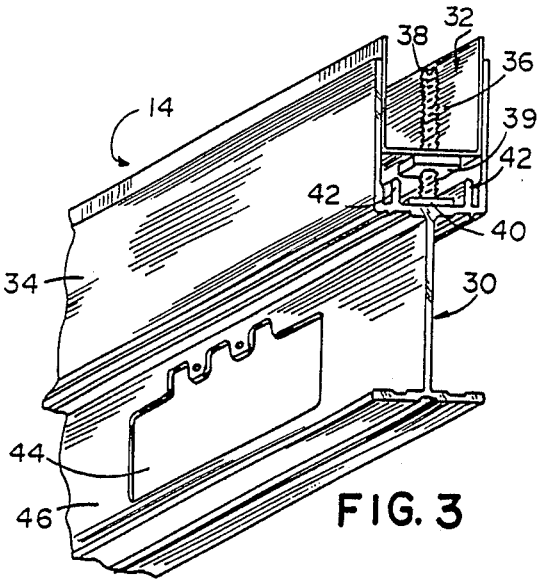
FIG. 3 is a fragmentary, perspective view of the floor leveler assembly of FIG. 2, taken in the region of arrow III in FIG. 2.

Floor leveler assembly 14 is horizontally levelled by setting to a predetermined heighth the adjustment bolt 36 at one end of leveler channel 32 and then adjusting the bolt 36 at the opposite end of leveler channel 32. The remaining intermediate adjustment bolts 36 are lowered until bolt heads 40 contact upper channel 34 in order to provide additional support for leveler channel 32 along its length. As shown in FIG. 3, protruding from the lower surface of upper channel 34 are two seating flanges 42 that provide a lower stop for leveler bracket 32. Bolt heads 40 are seated between seating flanges 42. Also shown in FIG. 3, upper channel 34 is raised above the floor surface in order to provide wire ways running along the base of floor runner 30. Molding covers are snapped into floor runner 30 beneath upper channel 34 to close and mask the wire ways. Electrical outlet mounting apertures 44 (FIG. 3) are knocked out from lower webbing 46 in order to permit the placement of electrical outlet boxes or other circuitry at selected locations along floor leveler assembly 14. Upper channel 34 is raised above the floor surface so that electrical conduit and the like may extend along floor runner 30 without interfering with the levelling mechanism or other various elements that are mounted on leveler assembly 14.

As shown in FIG. 5, ceiling channel 12 is a rectangular, inverted "U" shaped bracket that is secured to the ceiling by screws or other suitable conventional fasteners. Ceiling channel 12 includes two depending sidewalls 52 that are spaced to slidably receive the upper ends 100 of telescoping studs 16.

Figure 4:
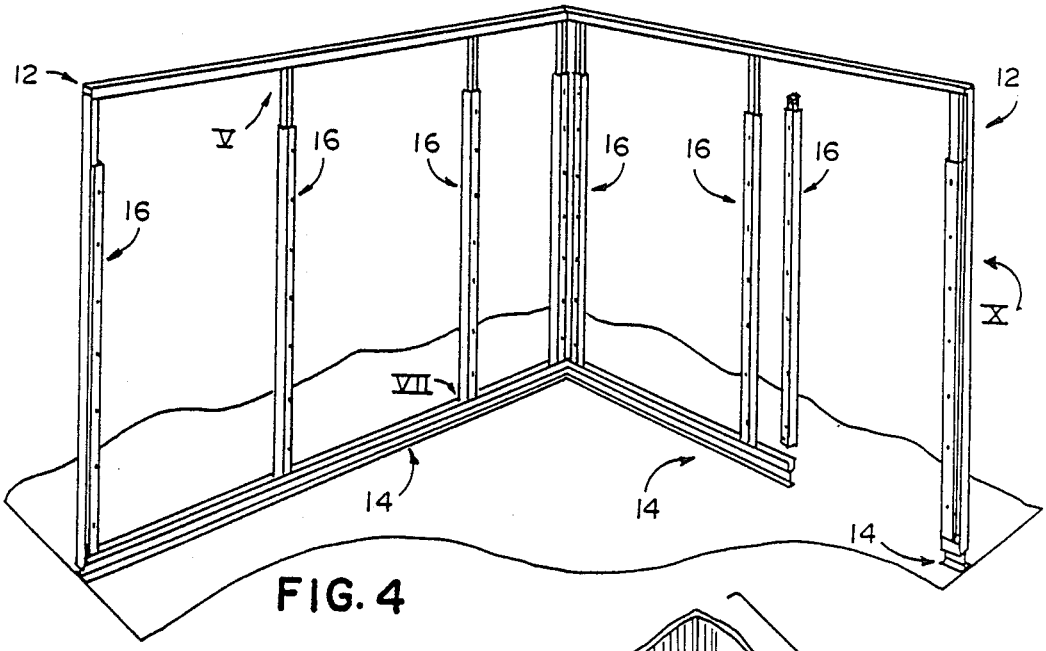
FIG. 4 is a perspective view of the vertical studs using the system of FIG. 1, shown being assembled onto the ceiling channel and floor leveler assembly.

As shown in FIG. 4, a series of telescoping studs 16 are roughly positioned between ceiling channel 12 and floor leveler assembly 14. As shown in FIG. 5, each telescoping stud 16 includes a rectangular upper post 100 that is telescopingly received in a lower base section 62. Vertically spaced along base section 62 are a series of accessory hanging slots 64 that are used to mount wall hanging accessories as described more fully below. A circular or rectangular post of compressible foam material is slid down into each telescoping stud 16 to extend along at least lower base section 62 in order to block light and reduce sound from passing through slots 64. The foam material compresses when hooks are inserted into slots 64.

Upper post 100 of each telescoping stud 16 is preferably extruded of aluminum and includes a wide central web 101 extending from one side thereof to the other and legs 102 extending laterally from each side, at each end, of web 101 (FIGS. 5 and 6). The length of web 101 and of legs 102 define the perimeter of upper stud member 100, and are dimensioned such that upper member 100 telescopes reasonably snugly within lower member 62 of stud 16.

Extending along the length of each end of web 101 and for some distance inwardly into web 101 are a pair of opposed slots 103. Slots 103 serve as means for mounting resiliently compressible friction members 120 on upper stud member 100.

Projecting laterally from the center of web 101 are a pair of spaced vertical walls 104 which define a third slot or channel 105. Slot 105 serves to receive screw 70 which is used to secure upper stud member 100 against movement with respect to lower stud member 62 (FIG. 6).

Each leg 102 of telescoping upper member 100 terminates in an enlarged bead **102*a*. Beads 102*a* provide some tolerance latitude, in that if upper member 100 is extruded so as to be slightly oversized, some of the surface material will scrape off beads 102*a* in engaging the interior of lower stud member 62 so that a slidable relationship can still be achieved. The exterior surfaces of legs 102 themselves, and the ends of web 101 itself, do not directly engage the interior surfaces of lower stud member 62**.

Threaded fastening member 70 comprises a self-tapping screw of approximately three-quarters of an inch. It is received in a suitable aperture near the top of lower stud member 62 and its threads dig into the interior surfaces of lateral walls 104 to positively secure upper stud member 100 against movement with respect to lower stud member 62 when such secureness is desired.

Resiliently compressible members 120 are preferably short lengths of conventional trim material usually referred to in the art as "T-molding." T-molding is typically extruded of a polymeric material such as polyvinyl chloride.

Each resiliently compressible member 120 includes a rearwardly projecting prong flange 121, which extends rearwardly from approximately the center of a support flange 122. Prong flange 121 includes a plurality of retainer barbs on either side thereof. Integrally extruded with support flange 122 is a slightly rounded facing member 123. These components are usually co-extruded in such a manner that prong 121 and flange 122 are of a somewhat more rigid polymeric material while facing portion 123 is of a more compressible polymeric material. It is typical to use polyvinyl chloride of two different durometers in order to achieve this variance.

Facing member 123 is preferably somewhat rounded in configuration as shown in FIG. 5 to facilitate insertion into ceiling channel 12. Compressible members 120 are positioned at the top of upper stud member 100 by inserting prong flanges 121 into slots 103 (FIG. 5). Slots 103 are configured so as to snugly receive prong 121 and are sufficiently deep that prong 121 can be fully inserted into slot 103. The plurality of barbs projecting laterally from each side thereof are slanted to facilitate insertion of prong 121 but hinder its removal from slots 103.

With both resiliently compressible members 120 in position on opposite sides of upper stud member 100, upper stud member 100 can be forced into position between the sidewalls 52 of ceiling channel 12. The rounded surface of compressible members 120 facilitates this insertion through a combined upward and sideward movement. Once in position within ceiling channel 12, the rounded surface portions 123 of resiliently compressible members 120 engage the inside surfaces of walls 52 in a friction manner. Sliding movement can be achieved within ceiling channel 12, but the friction fit is sufficiently snug that upper member 100 will be held in position within ceiling channel 12. Once in proper position, upper stud member 100 is locked in position by threading self-tapping screw 70 into slot 105, between walls 104.

Figure 7:
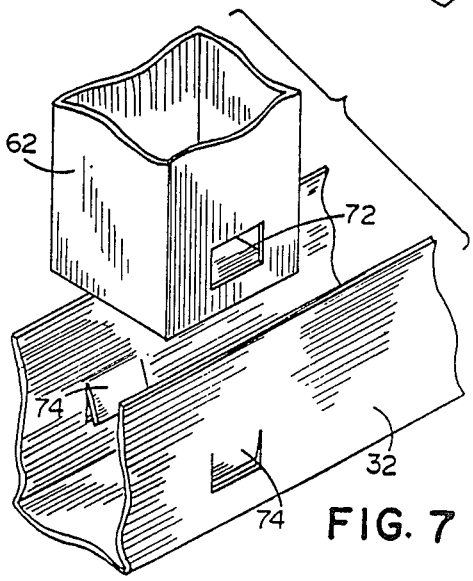
FIG. 7 is a fragmentary, perspective view of the lower end of a vertical stud being assembled onto the floor leveler assembly, taken in the region of arrow VII in FIG. 4.

As shown in FIG. 7, the lower end of base section 62 is slidably seated in leveler channel 32. The lower end of base section 62 includes a set of rectangular apertures 72 that mate with indented tabs or tangs 74 on the sides of leveler channel 32. During assembly base section 62 is snapped into place over tab 74 in order to roughly position telescoping studs 16 at predetermined intervals along floor leveler assembly 14. As shown in FIG. 4, telescoping studs 16 are each first seated in leveler channel 32 over one positioned tab 74, and upper member 100 is then raised until friction members 120 are seated frictionally within ceiling channel 12. The first telescoping stud 16 in the series of studs 16 is vertically aligned. The first stud 16 may be accurately aligned using a level, plumb bob, or the like, or in some installations visual alignment of the first telescoping stud 16 may be sufficient. Once aligned, screw 70 is tightened in order to fix the length of telescoping stud 16. The fixed length of telescoping stud 16 resists the lateral movement of upper post along ceiling channel 12, as does the frictional resistance provided by friction elements 120. Leveler channel 32 may also be provided without tabs 74, so that telescoping studs 16 may be seated anywhere along the length of channel 32. Friction between the sides of channel 32 and studs 16 maintain studs 16 in position.

Figure 8:
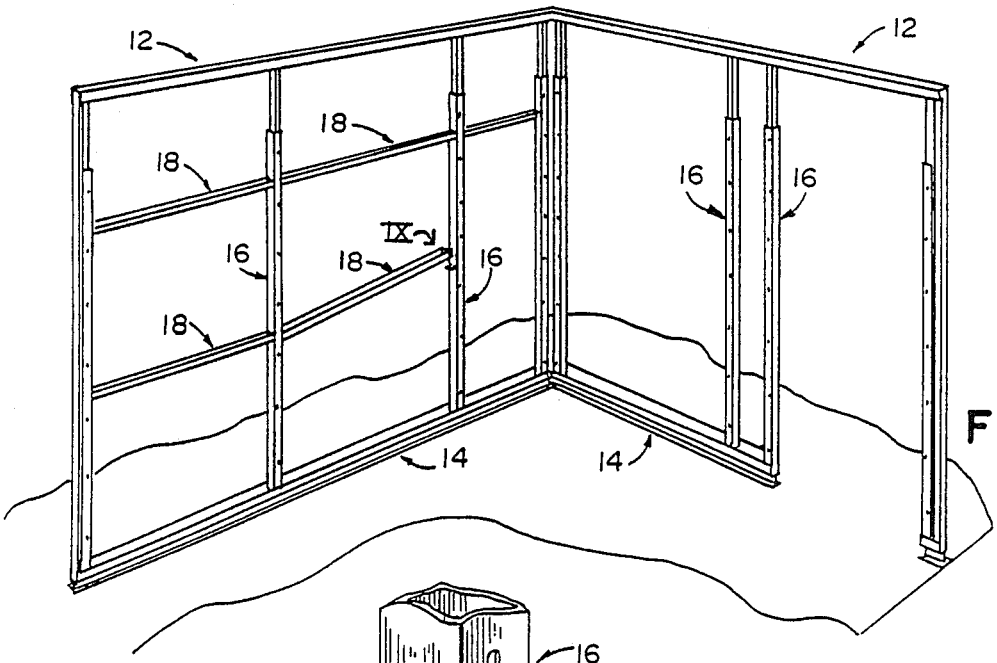
FIG. 8 is a perspective view of horizontal stringers used in the system of FIG. 1 shown being assembled onto the vertical studs.

As shown in FIG. 8, horizontal stringers 18 are secured between adjacent telescoping studs 16. Starting from the initial telescoping stud 16 that had been vertically aligned, a set of stringers 18 are secured between the aligned studs 16 and the next successive stud 16. the placement of stringers 18 automatically aligns the next successive telescoping stud 16. this sequence is followed down along the series of telescoping studs 16, so that the positioning of stringers 18 sequentially aligns each telescoping stud 16 automatically without requiring the assembler to align the individual studs 16 by conventional methods.

Figure 9:
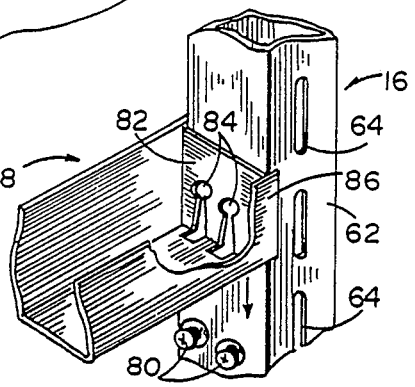
FIG. 9 is a fragmentary, perspective view of the end of a horizontal stringer being assembled onto a vertical stud, taken in the region of arrow IX in FIG. 8.

As shown in FIG. 9, stringers 18 are secured to lower section 62 of studs 16. Each lower section 62 includes two laterally spaced shoulder screws 80 set at predetermined heights along the length of lower section 62. Stringer 18 has a generally rectangular, upwardly opening U-shaped cross section, with a mounting tab 82 bent up at each end. Mounting tab 82 includes two keyhole slots 84 that widen and open out through the bottom of stringer 18. Keyhole slots 84 are spaced and configured to receive shoulder screws 80 with a snap-seating action and thereby rigidly join adjacent studs 16. The sidewalls of stringers 18 extend past mounting tab 82 to form two projecting alignment tabs 86 on both ends of each stringer 18. Alignment tabs 86 project slightly past the sides of telescoping studs 16 and slidably abut lower section 62 in order to form a shallow pocket in which lower section 62 is snugly received. Alignment tabs 86 provide additional rigidity to the joint formed between stringer 18 and studs 16. As shown in FIG. 8, a set of two stringers 18 are secured between each adjacent pair of studs 16 in order to square up the next successive telescoping stud 16.

Figure 1:
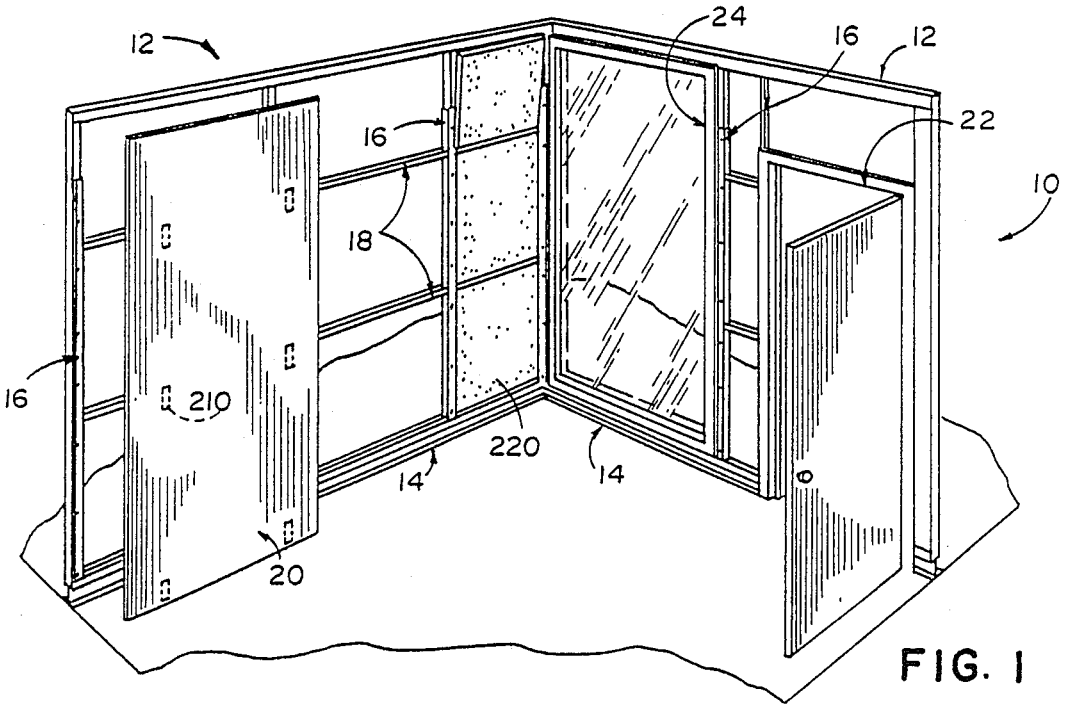
FIG. 1 is a perspective, exploded view of the wall system embodying the invention, showing the system in partially assembled condition.

Panels 20 are then hung in place on stringers 18. Suitable hooks 210 (shown hidden in FIG. 1) are provided for that purpose.

It is to be understood that the above is a description of the preferred embodiments and that one skilled in the art will recognize that various modifications or improvements may be made without departing from the spirit of the invention disclosed herein. The scope of protection afforded is to be determined by the claims which follow and the breadth of interpretation that the law allows.

The embodiments of the invention in which an exclusive property or privilege is claimed are defined as follows:

1. A floor-to-ceiling partition system comprising:

a telescoping stud including a lower portion, an upper portion including an upper end, and a pair of outwardly facing opposite sides, telescopically received in said lower portion;

at least one resiliently compressible friction member mounted on said upper portion of said stud in the vicinity of the upper end thereof, such that said friction member is located on at least one of the outwardly facing opposite sides of said upper portion of said stud, said upper portion of said stud comprises a slot in at least one of said opposite sides thereof, said compressible friction member includes a prong flange projecting rearwardly therefrom, said prong flange on said compressible friction member being frictionally received within its respective slot;

a ceiling channel, with a longitudinal axis, for securing to the ceiling of a room and including downwardly depending channel sidewalls;

said upper end of said upper portion of said stud being received within said ceiling channel and being dimensioned relative to said ceiling channel such that said compressible friction member is in frictional engagement with at least one of said channel sidewalls of said ceiling channel such that the upper end of the upper portion of said stud is movably secured within said ceiling channel for movement along the longitudinal axis of the ceiling channel, wherein the freedom of movement of said upper end of said stud includes a linear sliding motion and an arcuate swinging motion.

2. The partition system of claim 1 in which each of said friction members includes a laterally extending support flange, said prong flange projecting rearwardly from approximately the center of said support flange, there being a rounded surface portion located on the side of said support flange opposite said prong flange.

3. The partition system of claim 2 in which said compressible member is comprised of polymeric material of two different durometers, a first durometer polymeric material which is relatively stiff and rigid defining said prong flange and said support flange and a second durometer polymeric material which is softer and more resiliently compressible defining said rounded surface portion.

4. The partition system of claim 3 in which said lower portion of said stud includes an upper end and in which said upper portion of said stud comprises a third slot extending laterally with respect to said slots in said opposite sides of said stud upper portion; a self-tapping self-screw being mounted in said lower portion of said stud near the upper end thereof and being threaded into and engaging said third slot of said upper portion of said stud.

5. A floor-to-ceiling partition system comprising:

a telescoping stud including a lower portion, an upper portion including an upper end, and a pair of outwardly facing opposite sides, telescopically received in said lower portion;

at least one resiliently compressible friction member mounted on said upper portion of said stud in the vicinity of the upper end thereof;

said upper portion of said stud comprises a relatively thick web extending between the opposite, outwardly facing sides thereof and a pair of legs extending laterally from said web at each end thereof, one of said pair extending in one direction and the other of said pair extending in the opposite direction; there being a slot extending inwardly into said web from each end thereof whereby said slot opens outwardly on each said outwardly facing opposite side of said web; said friction member includes a prong flange projecting rearwardly therefrom which is inserted into said slot in frictional engagement therewith to hold said friction member in place on said upper portion of said stud;

a ceiling channel, with a longitudinal axis, for securing to the ceiling of a room and including downwardly depending channel sidewalls;

said upper end of said upper portion of said stud being received within said ceiling channel and being dimensioned relative to said ceiling channel such that said compressible friction member is in frictional engagement with at least one of said channel sidewalls of said ceiling channel such that the upper end of the upper portion of said stud is movably secured within said ceiling channel for movement along the longitudinal axis of the ceiling channel, wherein the freedom of movement of said upper end of said stud includes a linear sliding motion and an arcuate swinging motion.

6. The partition system of claim 5 in which each of said friction members includes a laterally extending support flange, said prong flange projecting rearwardly from approximately the center of said support flange, there being a rounded surface portion located on the side of said support flange opposite said prong flange.

7. The partition system of claim 6 in which said compressible member is comprised of polymeric material of two different durometers, a first durometer polymeric material which is relatively stiff and rigid defining said prong flange and said support flange and a second durometer polymeric material which is softer and more resiliently compressible defining said rounded surface portion.

8. The partition system of claim 7 in which said lower portion of said stud includes an upper end and in which said upper portion of said stud includes a pair of spaced walls projecting laterally from said web to define a screw receiving slot; said lower portion of said stud including a screw receiving aperture and a screw near the upper end thereof, said screw being threaded into said screw receiving slot with the threads thereof engaging the interior surfaces of said spaced screw slot defining walls.

9. The partition system of claim 5 in which said upper portion of said stud includes a pair of spaced walls projecting laterlly from said web to define a screw receiving slot; said lower portion of said stud including a screw receiving aperture and a screw near the upper end thereof, said screw being threaded into said screw receiving slot with the threads thereof engaging the interior surfaces of said spaced screw slot defining walls.

10. A partition system comprising:

a plurality of telescoping studs;

a floor engaging support member for said studs;

a ceiling channel, with a longitudinal axis, for securing to a ceiling channel, said ceiling channel including downwardly depending spaced sidewalls for receiving the upper ends of said telescoping vertical studs;

each of said telescoping studs comprising a lower portion engaging said floor engaging base support and an upper portion, including an upper end and a pair of opposite outwardly facing sides, telescopically received in said lower portion;

resiliently compressible friction members composed of a polymeric material mounted on said upper portion of each of said studs in the vicinity of the upper end thereof;

one of said friction members being located on each of the outwardly facing opposite sides of said upper portion of said stud whereby said pair of friction members engage said oppositely disposed channel sidewalls of said ceiling channel, said upper portion of said stud comprises a slot in each of said opposite sides thereof, each of said compressible friction members including a prong flange projecting rearwardly therefrom, said prong flange on each of said compressible members being frictionally received within its respective one of said slots;

said upper end of said upper portion of said stud being received within said ceiling channel with said friction member in a compressed state and applying an outward biasing force against at least one of said sidewalls of said ceiling channel such that said upper member is held in position in snug frictional engagement within said ceiling channel, but can be moved therein along the longitudinal axis of said channel until said stud is in its proper vertical alignment.

11. The partition system of claim 10 in which each of said friction members includes a laterally extending support flange, said prong flange projecting rearwardly from approximately the center of said support flange, there being a rounded surface portion located on the side of said support flange opposite said prong flange.

12. The partition system of claim 11 in which said compressible member is comprised of polymeric material of two different durometers, a first durometer polymeric material which is relatively stiff and rigid defining said prong flange and said support flange and a second durometer polymeric material which is softer and more resiliently compressible defining said rounded surface portion.

13. The partition system of claim 11 in which said lower portion of said stud includes an upper end and in which said upper portion of said stud comprises a third slot extending laterally with respect to said slots in said opposite sides of said stud upper portion; a self-tapping self-screw being mounted in said lower portion of said stud near the upper end thereof and being threaded into and engaging said third slot of said upper portion of said stud.

14. A partition system comprising:

a plurality of telescoping studs;

a floor engaging support member for said studs;

a ceiling channel, with a longitudinal axis, for securing to a ceiling channel, said ceiling channel including downwardly depending spaced sidewalls for receiving the upper ends of said telescoping vertical studs;

each of said telescoping studs comprising a lower portion engaging said floor engaging base support and an upper portion, including an upper end and a pair of opposite outwardly facing sides, telescopically received in said lower portion;

at least one resilient compressible friction member composed of a polymeric material mounted on said upper portion of each of said studs in the vicinity of the upper end thereof;

said upper portion of said stud comprises a relatively thick web extending between the opposite, outwardly facing sides thereof and a pair of legs extending laterally from said web at each end thereof, one of said pair extending in one direction and the other of said pair extending in the opposite direction; there being a slot extending inwardly into said web from each end thereof whereby said slot opens outwardly on each said outwardly facing opposite side of said web; said friction member including a prong flange projecting rearwardly therefrom which is inserted into said slot in frictional engagement therewith to hold said friction member in place on said upper portion of said stud;

said upper end of said upper portion of said stud being received within said ceiling channel with said friction member in a compressed state and applying an outward biasing force against at least one of said sidewalls of said ceiling channel such that said upper member is held in position in snug frictional engagement within said ceiling channel, but can be moved therein along the longitudinal axis of said channel until said stud is in its proper vertical alignment.

15. The partition system of claim 14 in which each of said friction members includes a laterally extending support flange, said prong flange projecting rearwardly from approximately the center of said support flange, there being a rounded surface portion located on the side of said support flange opposite said prong flange.

16. The partition system of claim 15 in which said compressible member is comprised of polymeric material of two different durometers, a first durometer polymeric material which is relatively stiff and rigid defining said prong flange and said support flange and a second durometer polymeric material which is softer and more resiliently compressible defining said rounded surface portion.

17. The partition system of claim 16 in which said upper portion of said stud includes a pair of spaced walls projecting laterally from said web to define a screw receiving slot; said lower portion of said stud including a screw receiving aperture and a screw near the upper end thereof, said screw being threaded into said screw receiving slot with the threads thereof engaging the interior surfaces of said spaced screw slot defining walls.

18. The partition system of claim 14 in which said lower portion of said stud includes an upper end and in which said upper portion of said stud includes a pair of spaced walls projecting laterally from said web to define a screw receiving slot; said lower portion of said stud including a screw receiving aperture and a screw near the upper end thereof, said screw being threaded into said screw receiving slot with the threads thereof engaging the interior surfaces of said spaced screw slot defining walls.

19. A floor-to-ceiling partition system comprising:

a telescoping stud including a lower portion and an upper portion, including an upper end, telescopically received in said lower portion;

at least one resiliently compressible friction member mounted on said upper portion of said stud in the vicinity of the upper end thereof;

a ceiling channel, with a longitudinal axis, for securing to the ceiling of a room and including downwardly depending channel sidewalls;

said upper portion of said stud includes at least one sidewall parallel to the longitudinal axis of the ceiling channel, and wherein the friction member comprises a resilient compressible body mounted to the sidewall of said upper portion of said stud, wherein the body of the friction member is bulbous in shape and composed of a compressible material;

said upper end of said upper portion of said stud being received within said ceiling channel and being dimensioned relative to said ceiling channel such that said compressible friction member is in frictional engagement with at least one of said channel sidewalls of said ceiling channel such that the upper end of the upper portion of said stud is movably secured within said ceiling channel for movement along the longitudinal axis of the ceiling channel, wherein the freedom of movement of said upper end of said stud includes a linear sliding motion and an arcuate swinging motion.

* * * * *